US007191497B2

(12) United States Patent
Butz

(10) Patent No.: US 7,191,497 B2
(45) Date of Patent: Mar. 20, 2007

(54) ASSEMBLY OF WATERPROOF ZIP AND TAPES

(75) Inventor: Marc Butz, Caslano (CH)

(73) Assignee: Crelux Holding SA, Mendrisio (CH)

( * ) Notice: Subject to any disclaimer, the term of this patent is extended or adjusted under 35 U.S.C. 154(b) by 0 days.

(21) Appl. No.: 11/156,701

(22) Filed: Jun. 21, 2005

(65) Prior Publication Data

US 2005/0235465 A1 Oct. 27, 2005

Related U.S. Application Data

(62) Division of application No. 10/485,212, filed as application No. PCT/IB03/01419 on Apr. 9, 2003, now Pat. No. 6,936,721.

(30) Foreign Application Priority Data

Jun. 25, 2002 (CH) ..... 1089/02

(51) Int. Cl.
*A44B 19/02* (2006.01)

(52) U.S. Cl. ..... 24/389; 2/82; 2/87

(58) Field of Classification Search ..... 24/381, 24/384, 385, 389, 390, 398, 416, 432; 2/82, 2/87, 96, 2.17, 128
See application file for complete search history.

(56) References Cited

U.S. PATENT DOCUMENTS 2,674,559 A 4/1954 Zobel
3,417,406 A * 12/1968 Rosenbaum ..... 2/2.17
3,561,073 A 2/1971 Rosser
3,624,871 A 12/1971 Osterkorn
3,859,150 A 1/1975 Van Amburg
3,883,381 A 5/1975 Thaeler
3,884,738 A 5/1975 Hofius, Sr.
3,924,305 A 12/1975 Hamamura
3,936,923 A * 2/1976 Cantor ..... 29/408
5,159,719 A 11/1992 Aumann
5,444,898 A 8/1995 Norvell
5,529,823 A 6/1996 Aumann
6,571,432 B1 6/2003 Rindle
6,651,254 B1 11/2003 Chang
6,668,384 B1 12/2003 Chang
6,675,390 B1 1/2004 Chang
6,691,326 B2 2/2004 Hexels
2002/0017010 A1 2/2002 Neugebauer

* cited by examiner

*Primary Examiner*—Jack W. Lavinder
(74) *Attorney, Agent, or Firm*—Young & Thompson

(57) ABSTRACT

A method of sealing the join between two tapes to which the teeth of a waterproof zip are attached and two edges of a garment composed of a first or waterproof layer and a second or fabric layer, which comprises: a) applying to a first side of each tape, a strip of heat-weldable textile material attached to it, by at least one weld line, such that each strip comprises a first and a second flap; b) welding the edge of the first layer to one face of the flap furthest from the teeth; c) attaching the edge of the second layer to the second side of each tape; d) folding down the flap nearest to the teeth of the zip; and e) forming another weld that hermetically joins the outline of the outer edges of the flap to the corresponding tape around the area.

3 Claims, 5 Drawing Sheets

ASSEMBLY OF WATERPROOF ZIP AND TAPES

CROSS REFERENCE TO RELATED APPLICATIONS

This is a division of application Ser. No. 10/485,212, now Pat. No. 6,936,721, which was filed on Jan. 29, 2004, as the 35 USC 371 national stage of international application PCT/IB2003/001419 filed on Apr. 9, 2003, which designated the United States of America.

FIELD OF THE INVENTION

The present invention relates to the technological area of waterproof garments, for nautical sports, leisure or similar purposes, composed of two superimposed layers, one of which is waterproof and the other of fabric, the layers having one or more waterproof zips whose teeth are attached to two adjacent tapes connected to the two opposite edges of the garment.

BACKGROUND OF THE INVENTION

Although no major problems are encountered when hermetically joining together the said tapes and the waterproof layer by a welding process, a problem arises when the tapes are to be attached to the fabric of the other layer. This operation necessarily requires making a seam, through the holes of which, although partially occluded by the thread of the seam, water can get in, which defeats the object of using a waterproof zip.

The prior art seeks to avoid this problem by the application of flaps of complicated configuration which, when folded against the zip and the seams, protect the seams, largely mechanically, from water ingress.

This system is not only fiddly to apply but also not very dependable, and is not a one hundred percent reliable solution.

SUMMARY OF THE INVENTION

To avoid the problems explained above, the inventor of the present innovation has devised what is as far as he is aware a novel method involving the application by welding to the said tapes strips of heat-weldable textile material that comprise two unattached flaps arranged longitudinally with respect to their weld line, which can be used, as will be explained in more detail later, to attach the zip to the impermeable layer and to cover, with a reliable sealing action, the area of the seams made in attaching the fabric layer.

The subject of the present invention is thus a method of sealing the join between the two tapes to which the teeth of a waterproof zip are attached and two edges of a garment.

The present invention also relates to an assembly of components connected together in such a way as to enable the said method to be carried out.

A more detailed description of the method of the invention and of the said assembly of components connected together in such a way as to carry it out will now be given.

BRIEF DESCRIPTION OF THE DRAWINGS

The abovementioned description will refer to the accompanying drawings, which show.

DETAILED DESCRIPTION OF THE INVENTION

Figure 1:
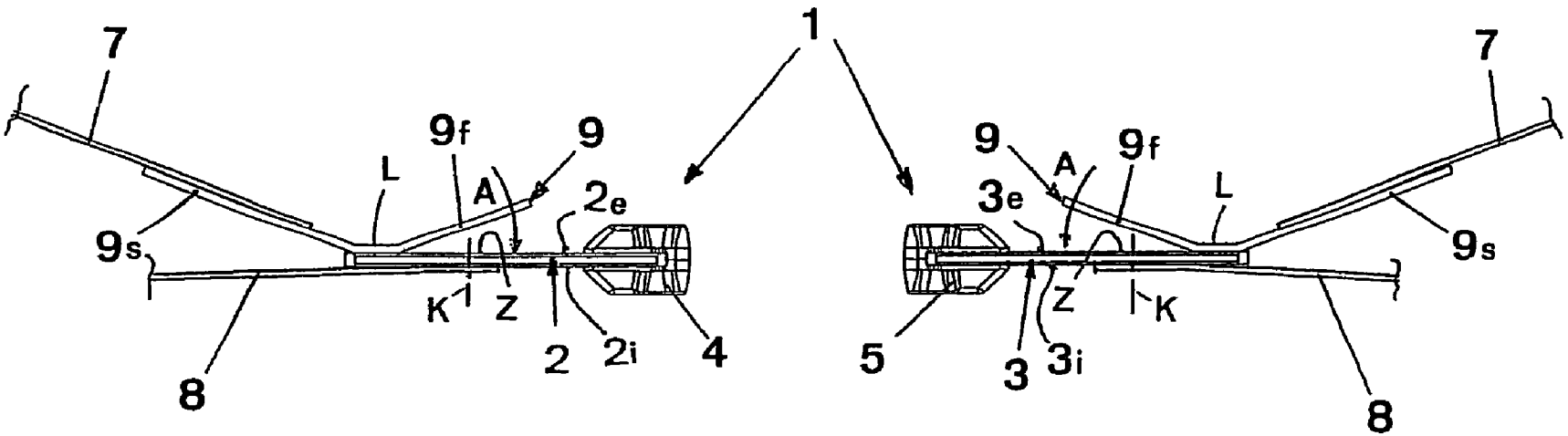
in FIG. 1 a cross section through a waterproof zip with the two rows of teeth not connected, in which the method of the invention is being carried out, the strips of heat-weldable textile material not yet having been welded to their tapes in such a way as to cover the area of the seam of the lining.
Figure 2:
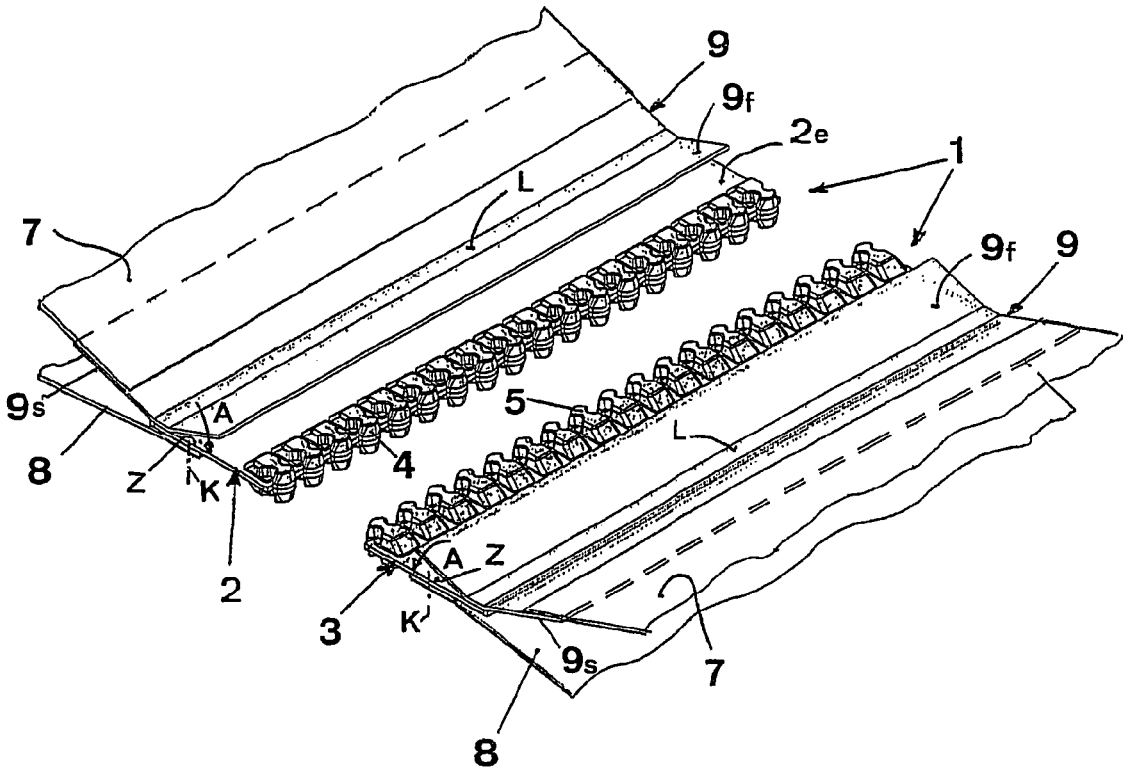
in FIG. 2 a perspective view of the same zip as in FIG. 1.

Referring to FIGS. 1 and 2, these show a waterproof zip 1 in the course of the method of the invention for sealing its join: the said zip 1, in accordance with known principles, consists of two rows of teeth 4, 5 attached to two tapes 2, 3, e.g. of plastic, whose job it is to join together two edges of garment (not shown in its entirety). In the present case the garment is composed of a waterproof outer layer 7, which may likewise be made of plastic, and a textile lining 8 covering the inside.

Applied to the outside 2*e*, 3*e* of each of the said tapes 2, 3 is a strip 9 of heat-weldable textile material. It is attached by at least one weld line L formed along a longitudinal line parallel to the rows of teeth 4, 5 in such a way that the strip 9 comprises a first unattached flap 9*f* and a second unattached flap 9*s*, one on each side of the said weld line L.

The said waterproof outer layer 7 is attached, also by welding, to the outer face of the flap 9*s* furthest from the teeth 4, 5, while the lining 8 is attached by means of a seam K to the inside of the respective tape 2, 3. It follows that all the stitches of the seam K lie in an area Z situated between the said weld line L and the associated row of teeth 4, 5.

Figure 3:
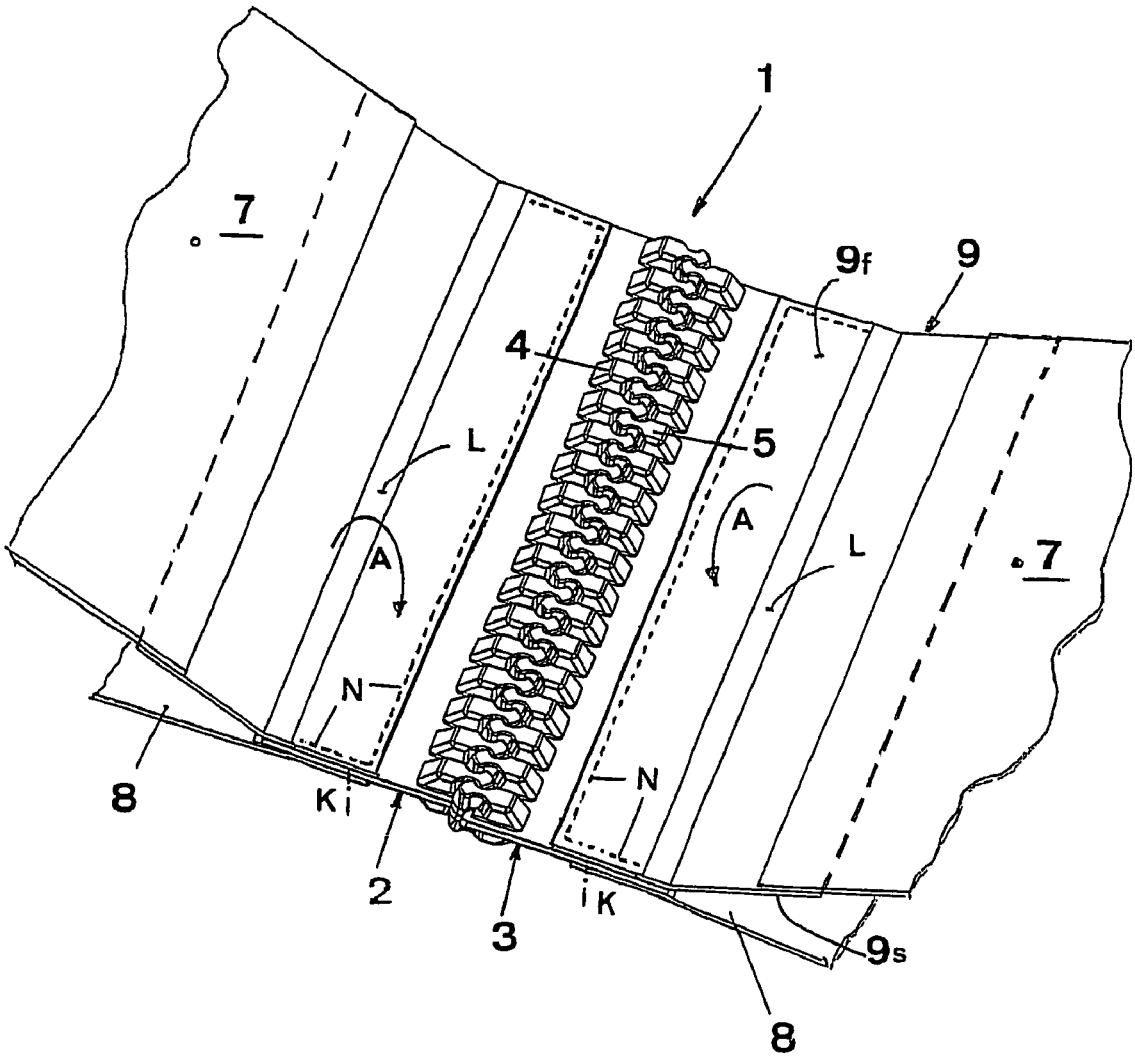
in FIG. 3 a perspective view of the same zip as in the previous figures with the strips of heat-weldable textile material welded to their tapes and with the two rows of teeth of the zips connected together.

At this point (see also FIG. 3) the flap 9*f* of each strip 9 situated closest to the teeth 4, 5 is folded down (arrows A) parallel against the outside of the respective tape 2, 3, entirely covering the said area Z of the seam K.

Another weld line N is then produced in such a way that each flap 9*f* situated nearest the teeth 4, 5 has the outline of its outer edges hermetically joined to the respective tape 2, 3, which in the example in question is made of plastic, thereby surrounding the abovementioned area Z.

The result of this is that all the stitches of the seam K of the said area Z between the said flap 9*f* and the respective tape 2, 3 are hermetically closed, preventing any infiltration of water through the said stitches.

Figure 4:
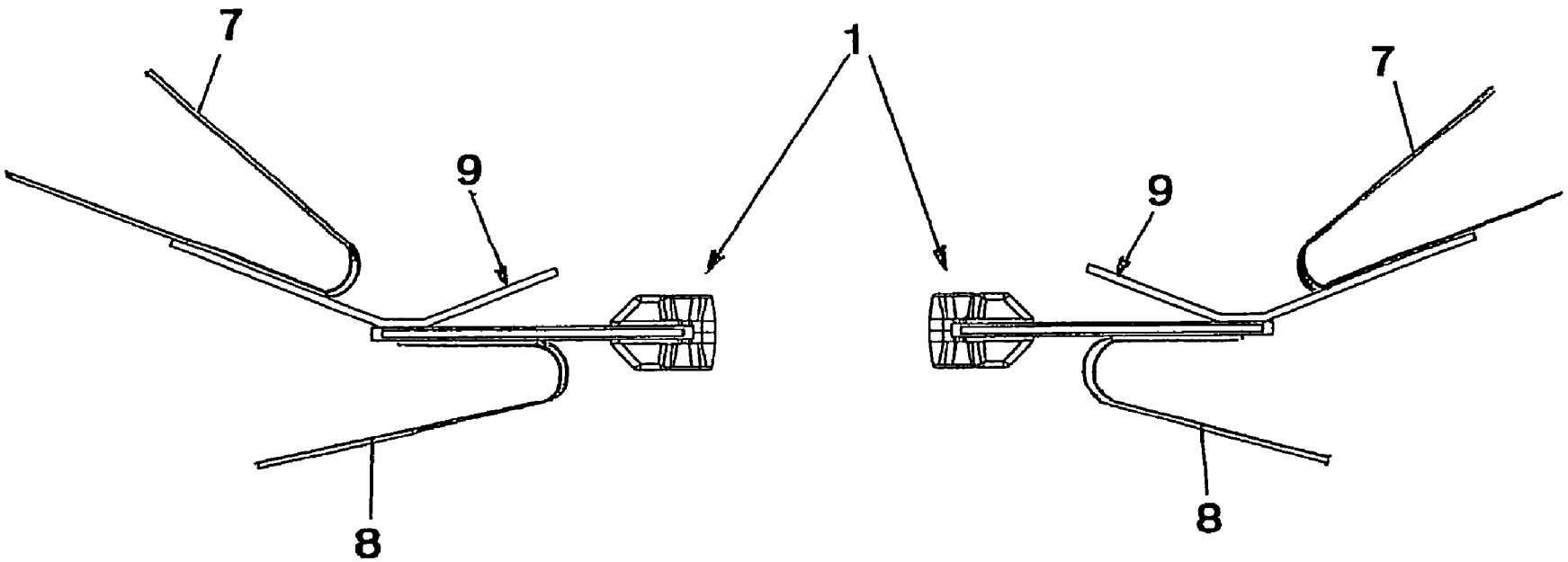
in FIG. 4 the same view as in FIG. 1 but with the garment edges folded differently; and in FIG. 5 the same view as in FIG. 1 with the two layers of the garment in the reverse relative arrangement.

In the figures considered thus far both the waterproof outer layer 7 and the lining 8 are directed, at points where they are attached to other parts, towards the teeth 4, 5 of the zip 1, but they can also be folded, forming a roll as indicated in FIG. 4, so as to be directed in the opposite direction. For aesthetic and functional reasons this is generally the most common form.

Figure 5:
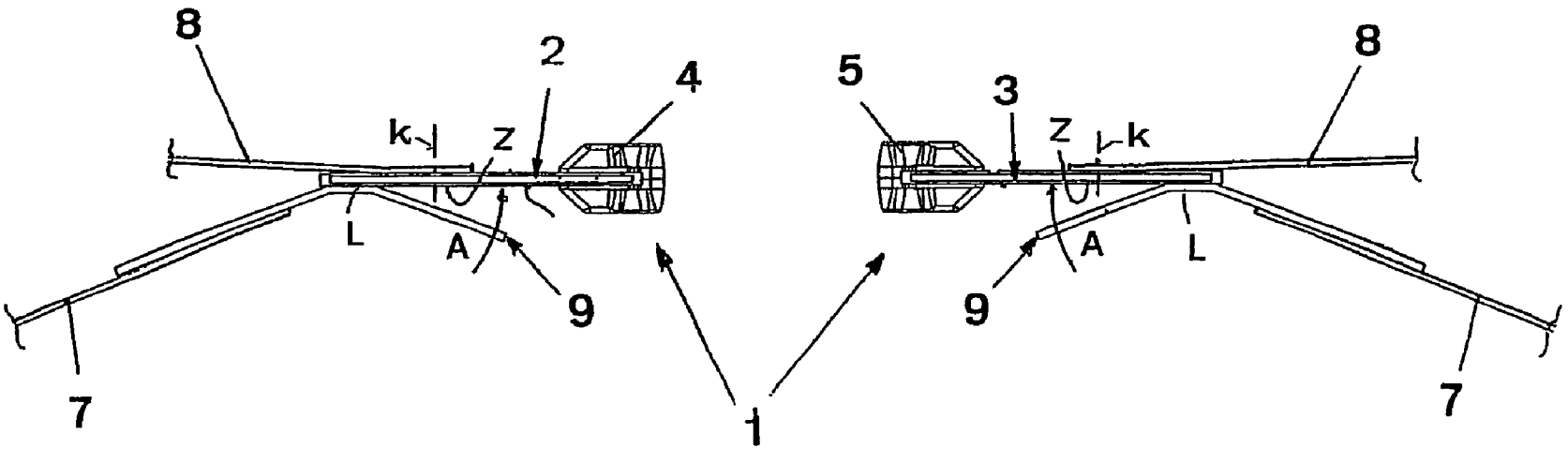

FIG. 5 shows the same process being applied to a waterproof zip 1 identical to that described above, with the only difference that the waterproof layer 7 is situated on the inside of the garment and the fabric layer 8 on the outside. All the considerations made in relation to the previous case also apply here.

Both the abovementioned seam K and the said welds are produced by known systems and principles. In particular all the welds referred to can be produced by hot air jet, by high-frequency thermal induction processes, by chemical welding or by other methods producing a similar effect. Clearly, the materials that form the outer layer 7 and the tapes 2, 3 must be chosen to be compatible for the desired type of welding.

The invention claimed is:

1. An assembly of a waterproof zip and tapes to which teeth of the zip are attached, said assembly comprising:

a waterproof zip having teeth;

a pair of tapes connected to the zip, said pair of tapes both having first and second sides;

a strip of heat-weldable textile material welded to each respective said first side along a first longitudinal weld line, said strip having a first flap and a second flap extending longitudinally on each side of said first weld line and parallel with said teeth;

a textile material connected to each respective said second side along a longitudinal seam, said first flap extending over and covering said seam and being welded to a corresponding said first side along a second longitudinal weld line; and a waterproof material connected to said second flap.

2. The assembly as claimed in claim 1, wherein said pair of tapes are a plastic material.

3. An assembly of a waterproof zip and tapes to which teeth of the zip are attached, said assembly comprising:

a waterproof zip having teeth;

a pair of tapes directly connected to the zip, said pair of tapes both having first and second sides; and a strip of heat-weldable textile material welded to each said first side along a first longitudinal weld line, said strip having a first flap and a second flap extending longitudinally on each side of said first weld line and parallel with said teeth, without overlapping said teeth.

* * * * *

UNITED STATES PATENT AND TRADEMARK OFFICE

CERTIFICATE OF CORRECTION

PATENT NO. : 7,191,497 B2
APPLICATION NO. : 11/156701
DATED : March 20, 2007
INVENTOR(S) : Marc Butz It is certified that error appears in the above-identified patent and that said Letters Patent is hereby corrected as shown below:

On the title page, amend Item (62) to read as follows:

--(62) Division of application No. 10/485,212, filed as application No. PCT/1B03/01419 on Apr. 9, 2003, now Pat. No. 6,936,121.--

In column 1, line 8, amend the Patent No. "6,936,721" to read:

--6,936,121--.

Signed and Sealed this

Twenty-second Day of May, 2007

JON W. DUDAS
*Director of the United States Patent and Trademark Office*